United States Patent [19]

Grove

[11] 4,039,094

[45] Aug. 2, 1977

[54] AERIAL LIFT PLATFORM WITH EXTENDABLE WHEELS

[75] Inventor: John Landis Grove, Greencastle, Pa.

[73] Assignee: Fulton Industries, Inc., McConnellsburg, Pa.

[21] Appl. No.: 643,871

[22] Filed: Dec. 23, 1975

[51] Int. Cl.[2] ..... E02F 3/70

[52] U.S. Cl. ..... 214/132; 180/145; 180/DIG. 2; 182/2; 212/145; 214/141; 280/638

[58] Field of Search ..... 214/132, 138 R; 212/145; 180/DIG. 1, DIG. 2, 9.48, 145; 280/638, 656, 42, 150.5; 182/2

[56] References Cited

U.S. PATENT DOCUMENTS

| | | | |
|---|---|---|---|
| 3,310,181 | 3/1967 | Symmank | 212/145 |
| 3,625,381 | 12/1971 | Menzi | 280/638 |
| 3,656,780 | 4/1972 | Nordstrom | 214/138 R |
| 3,712,398 | 1/1973 | Althaus | 180/9.48 |

FOREIGN PATENT DOCUMENTS

| | | | |
|---|---|---|---|
| 209,724 | 6/1960 | Austria | 280/638 |

*Primary Examiner*—Robert J. Spar
*Assistant Examiner*—Ross Weaver
*Attorney, Agent, or Firm*—Irvin A. Lavine

[57] ABSTRACT

An aerial lift platform apparatus has a wheeled chassis, a turret on the chassis and a boom pivoted to the turret. The wheels are carried by extendable axles, to provide increased stability. The boom is depressed to raise at least one wheel, to permit its extension and retraction. Preferably, there are four wheels on two axles, and the wheels of each axle are successively raised and then extended or retracted.

4 Claims, 4 Drawing Figures

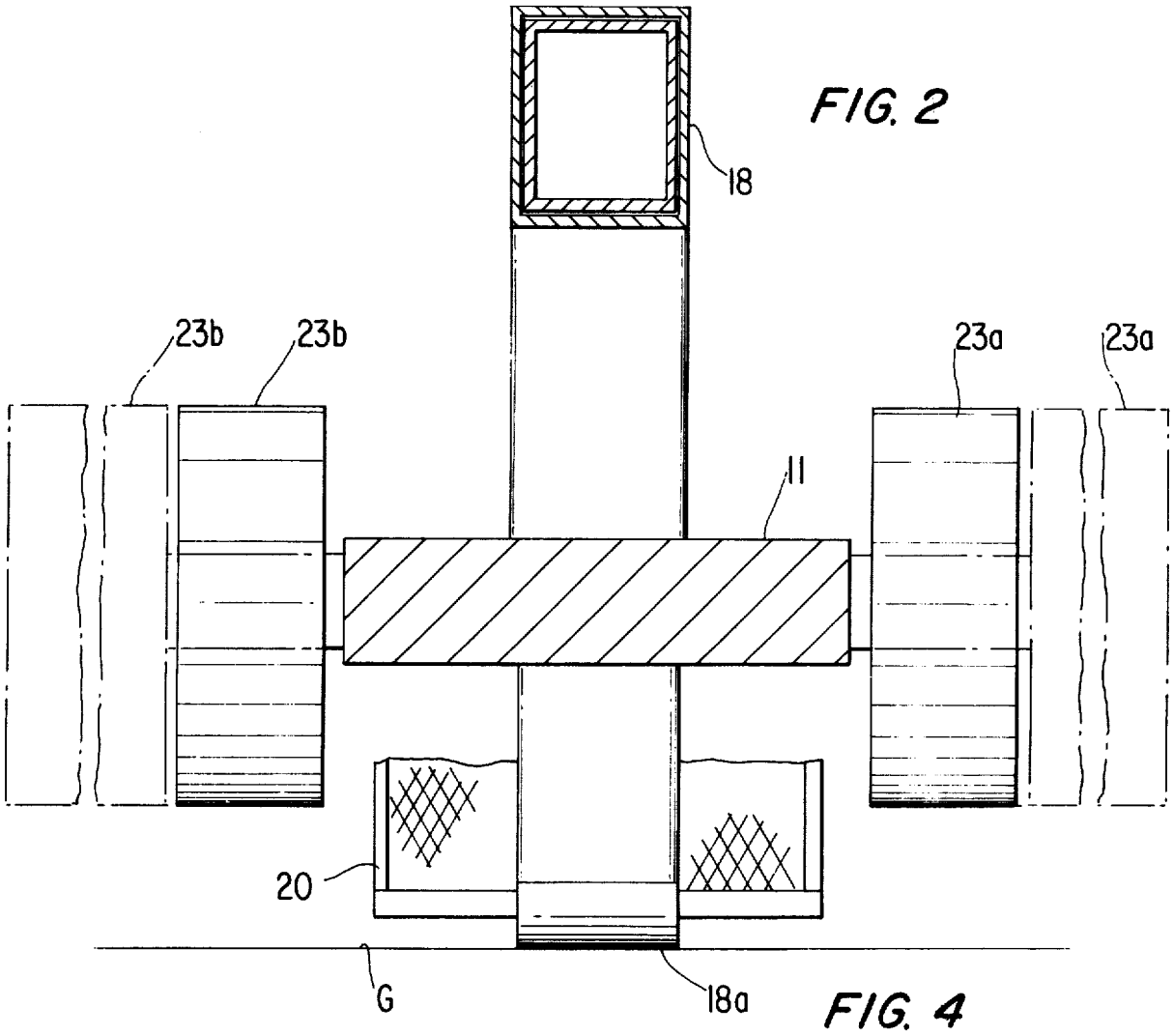
FIG. 2
FIG. 4
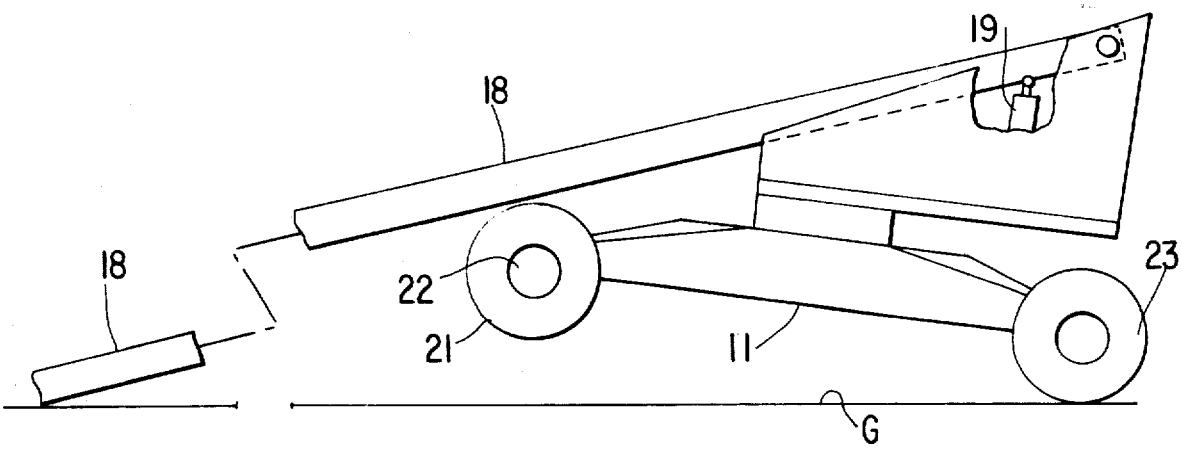

AERIAL LIFT PLATFORM WITH EXTENDABLE WHEELS

BACKGROUND OF THE INVENTION

The present invention relates to aerial lift platforms, or cranes, mounted on a wheeled chassis, and including a rotatable turret and linearly extending boom.

There have been provided cranes which comprise a chassis, and wheels or the like for engaging the ground and enabling the chassis to move over the ground. The chassis supports a generally linearly extending boom, and typically the boom is carried on a horizontal pivot that is supported by a rotatable turret, the turret being rotatable about a generally vertical axis. The boom may be telescopic, and, in a crane, has at its outer end a load support, such as blocks and a cable. Similar devices, known as aerial lift platforms, have provided a workman's platform or basket at or near the outer end of the boom, for supporting a workman at an elevated location. Both cranes and aerial lift platforms are capable of being positioned so that there is a substantial overturning moment. This overturning moment has been counteracted by counterweights, and by so-called outriggers. The outriggers may be caused to extend outwardly from the chassis, and to provide for engagement with the ground at a distance or spacing greater than that of the ground engaging wheels, or the like. Another provision for increasing the stability of such cranes and aerial lift platforms has been to provide the wheels with extendable axles, so that the wheels could be placed at relatively great distances from the chassis, to increase stability during operation of the crane or aerial lift platform, the wheels being retracted so as to be relatively closer to the chassis during transit.

SUMMARY OF THE INVENTION

Equipment such as a crane, and more particularly an aerial lift platform is provided, having a mobile chassis, the chassis being mounted on such ground engaging means as wheels. Preferably, the chassis is provided with front and rear extendable axles, with each axle carrying two wheels. A turret is carried on the chassis, rotatable about a generally vertical axis. A linearly extending structural member is provided, pivoted to the turret for movement in a vertical plane, about a horizontal pivot. This structural member, or boom, carries at its outer end, remote from the pivot, a load supporting structure, which is a workman's platform in the case of an aerial lift platform apparatus. The structural member or boom is depressed below horizontal, to engage the ground or other support surface, and is thereby stressed abnormally, with the underside of the structural member or beam being in tension, and the upper side being in compression, whereas in normal usage, when supporting a load, the upper side is in tension and the lower side is in compression. A force exerted on the structural member causes the chassis to be pivoted upwardly, specifically about one or the other of the axles, raising an axle and the wheels carried by it out of engagement with the ground. The axles are then extended, preferably by a hydraulic motor, and the elevated wheels are then lowered. The boom is raised, and rotated, preferably through approximately 180°, and is again lowered to engage the ground, the boom stressed in the abnormal manner noted, with the other axle then being raised and the other set of wheels being extended. The last mentioned wheels are then lowered to the ground, and the equipment is then prepared for use in its most stable condition or state.

BRIEF DESCRIPTION OF THE DRAWINGS

FIG. 2 is a cross-sectional view taken on the line 2—2 of FIG. 1.

FIG. 4 is an elevational view, similar to FIG. 1, showing a second set of wheels elevated from the ground.

DESCRIPTION OF THE PREFERRED EMBODIMENT

Figure 1:
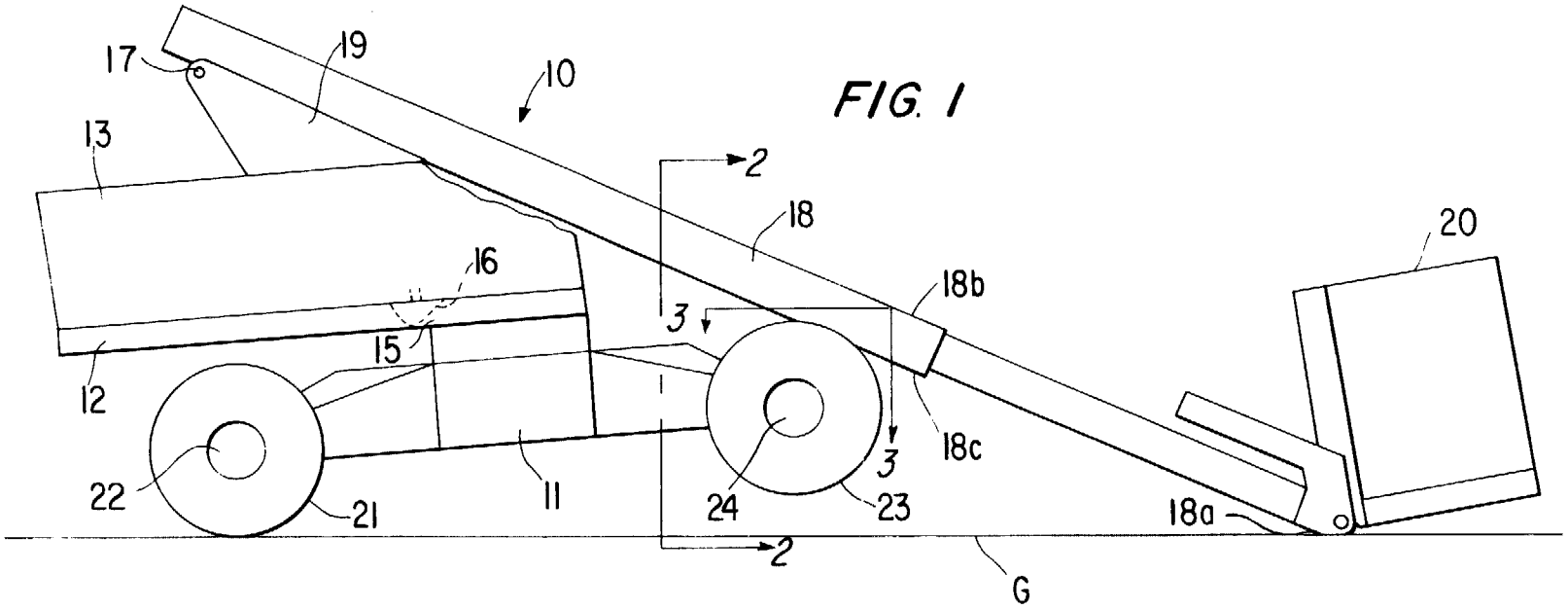
FIG. 1 is an elevational view of an aerial lift platform in accordance with the present invention.

Referring now to the drawings, wherein like or corresponding reference numerals are used for like or corresponding parts throughout the several views, there is shown in FIG. 1 an aerial life platform apparatus 10 which includes a chassis 11, and having a turret 12 rotatably supported on the chassis, for rotation about an axis which is generally vertical when the apparatus 10 is level, and on level ground. Within the turret 12 is an internal combustion engine 13, connected in conventional manner to gearing 15 which engages a ring gear 16 of the chassis 11. Thereby, the turret 12 is rotated. The turret has a generally horizontal pivot pin 17, which serves to pivotally connect a telescopic boom 18 to the turret 12. A hydraulic cylinder 19, connectable to a pump and a reservoir (not shown) is used to pivot the boom 18 about the pivot 17. At its outer end, remote from the pivot 17, the boom 18 carries a workman's platform 20.

The chassis 11 is supported by a pair of rear wheels 21, one of which is shown in FIG. 1, the wheels 21 being carried by an extendable axle 22. The front wheels 23 are carried by an extendable axle 24, and the wheels 23 are shown in FIG. 1 to be raised above the ground G. The forward or outer end of the boom 18 has a portion **18*a* thereof which engages the ground, and as is apparent from FIG. 1, the chassis 11 has been rotated about the rear axle 22, raising the front wheels 23 off of the ground. In the position shown in FIG. 1, the upper side 18*b* is in compression, while the lower side 18*c* of the boom 18 is in tension. This is an abnormal situation, since in normal use, the boom 18 is elevated so as to support the platform 20 at a location above the ground, thereby beam-loading the boom 18 in the normal manner, in which the upper side 18*b* is in tension and the underside 18*c*** is in compression.

Referring now to FIG. 2, there may be seen the front wheels **23*a* and 23*b* in their retracted positions, these wheels being shown in dotted lines in their extended positions, it being understood that the amount of extension of the wheels 23*a* and 23*b* is, in practice, substantially more than is indicated in FIG. 2. The boom 18 may be seen, both in cross-section and in elevation, carrying at its end the platform 20, and having the portion 18*a* engaging the ground G. The boom 18 as shown in FIG. 2 is loaded in the abnormal manner hereinabove referred to, and as will be understood after the boom 18 has been placed in position so as to extend over the axle 24, by rotation of turret 12, it is lowered, and then continued supply of pressure fluid to the cylinder 19 effects abnormal loading of the boom 18, and the aforementioned pivoting the chassis 11 about the rear axle 22, to elevate the front wheels 23*a* and 23*b***.

Figure 3:
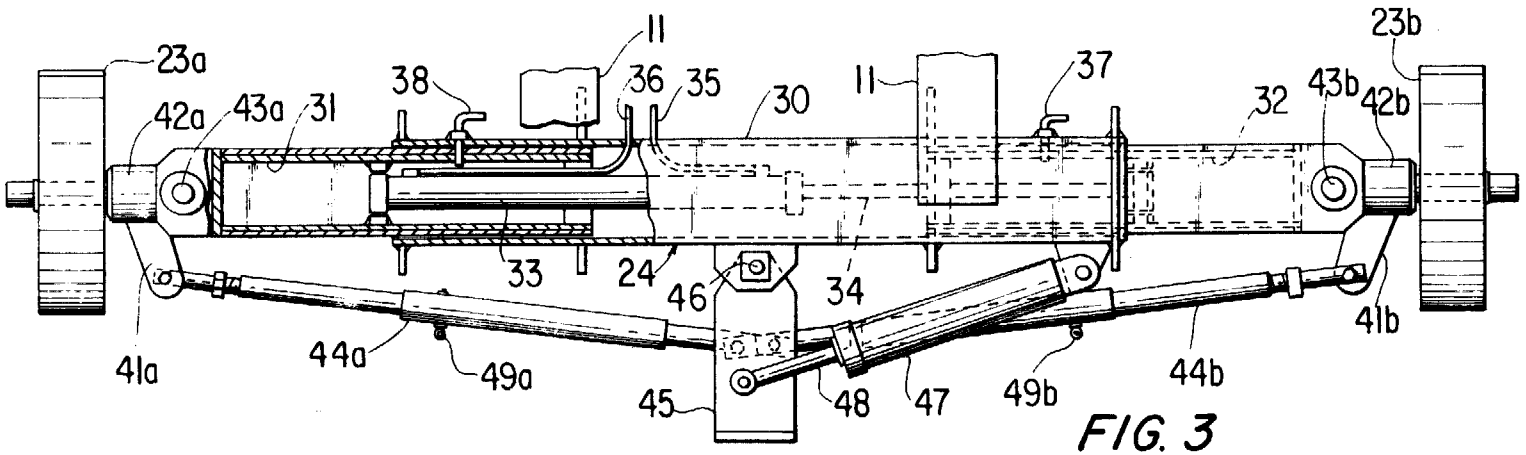
FIG. 3 is a cross sectional view taken on the line 3—3 of FIG. 1.

Referring now to FIG. 3, there may be seen the chassis 11, which includes a forward box beam 30. A pair of stub axles 31 and 32 are telescoped into each end of the box beam 30, with the stub axle 31 being pivotally connected to a cylinder 33, with which there coacts a piston having a piston rod 34. Piston rod 34 is pivotally connected to the stub axle 32. A hydraulic hose 35 is connected to one end of the cylinder 33, to provide for retraction of the piston rod 34, while a second hydraulic hose 36 is connected to the opposite end of the cylinder 33, to effect extension of the wheels 23*a* and 23*b*. Locking pins 37 and 38 are provided to pass through holes in the box beam 30 and the stub axles 31 and 32, to lock the stub axles in the extended and retracted positions.

The steering system for the front wheels 23*a* and 23*b* is provided by steering levers 41*a* and 41*b* which cause movement of the axle shafts 42*a* and 42*b* about vertically extending pivots 43*a* and 43*b*. These levers 41*a* and 41*b* are connected by tie rods 44*a* and 44*b* to a bar 45 which is pivotal about a generally vertically extending pivot pin 46, in a horizontal plane. The tie rods are pivotally connected to the bar 45 and to the levers 41*a* and 41*b*. A hydraulic steering motor 47 is pivotally connected to the box beam 30, having its piston rod 48 pivotally connected to the bar 45, so that upon supplying fluid under pressure to one end or the other of the motor 47, the wheels 23*a* and 23*b* may be steered in one direction or the other. The telescopic tie rods 44*a* and 44*b* are provided with locking pins 49*a* and 49*b*, which pass through appropriate holes in the telescopic tie rods, so as to lock them in either their extended or retracted positions, corresponding to the extended and retracted positions of the extendable axle 24.

In the preferred operation, referring first to FIG. 1, the turret 12 is rotated so as to position the boom 18 over the axle 24, after which the cylinder 19 is actuated to cause the end portion of the boom 18 to engage the ground, thereby abnormally stressing the boom 18 in the manner above indicated, with continued application of force by the cylinder 19 raising the front wheels 23 off the ground, the chassis 11 pivoting about the rear wheels-axle. The extension motor including the cylinder 33 is energized so as to vary the distance of the wheels 23*a*, 23*b* from the chassis 11, after the locking pins 37, 38 49*a* and 49*b* have been withdrawn. For example, the wheels 23*a* and 23*b* may be extended outwardly from the chassis 11. The cylinder 19 is then actuated in the opposite manner, so as to effect rotation of the chassis 11 downwardly, to thereby enage the front wheels 23 with the ground G. The boom 18 is then raised, and the turret 12 is then rotated, through approximately 180°. Referring to FIG. 4, the boom 18 is then lowered, after being positioned over the rear axle 22, the cylinder 19 is then energized in the manner aforesaid, to rotate the chassis 11 upwardly on the front wheel-axle thereby elevating the rear wheels 21, as shown. The rear axle 22, being substantially identical to the front axle 24, has the extension motor thereof (not shown) actuated, so as to move the two rear wheels 21 outwardly from the chassis 11, after which actuation of cylinder 19 is reversed, to thereby permit the rear wheels 21 to be lowered into engagement with the ground. As will be understood, the various locking pins are removed, and reinserted, first to permit movement of the wheels, as from the inner position to the outer position thereof, and then reinserted to lock them in the outer, stabilizing position thereof.

With the wheels extended in the manner aforesaid, the aerial lift platform apparatus 10 has a relatively wide-spread, stable base, and work may thereby be performed, moving the platform 20 to various elevated positions. When the apparatus 10 is to be transported, as for example onto a transport vehicle or through a relatively narrow doorway, the above noted steps are carried out, with energization of the extension motors being effected to retract the wheels. The description hereinabove given provides for the lifting of the two front wheels simultaneously, and the two rear wheels simultaneously, but it is within the contemplation of the present invention that one wheel at a time may be lifted, or the two wheels on each side may be lifted simultaneously. Further, the herein described apparatus is shown in the preferred embodiment, wherein it is a four wheeled apparatus, with two axles, that it will be understood that other arrangements may be provided, such as where there is only one extendable axle.

There has been provided an aerial lift platform apparatus having extendable wheels, with provision for raising one or more of the wheels through engagement of the boom with a supporting surface, such as the ground, with abnormal stressing of the boom, and elevation of one or more wheels, to permit extension or retraction thereof. Further, there has been provided a method in which first the wheels on one axle are raised, and their position relative to the chassis changed, and then the other set of wheels are raised, with the first set being on the ground, and the wheels of the other set moved relative to the chassis, the boom being, in each case, preferably over the axle which is carrying the wheels raised above the ground.

It will be obvious to those skilled in the art that various changes may be made without departing from the spirit of the invention, and therefore the invention is not limited to what is shown in the drawings and described in the specification but only as indicated in the appended claims.

I claim:

1. The method of providing stabilization of a vehicle, said vehicle comprising a chassis, front and rear axles supporting said chassis, and wheels on said front and rear axles for supporting said vehicle, and wherein said vehicle further comprises a turret rotatably mounted on said chassis and means for rotating said turret about a vertical axis, a boom pivotally secured to said turret on a horizontal axis and means for vertically pivoting said boom, said boom being telescopic and means for telescopically extending and retracting said boom, said boom having a workman-supporting platform at the end thereof remote from said turret, said method comprising:

a. providing extensible supports for said axles,
b. providing motor means for extending and retracting said axles,
c. positioning said turret so that said boom extends over a first axle,
d. pivoting said boom downwardly by operation of said boom pivoting means to engage the outer end of said boom with the ground and continuing operation of said boom pivoting means to thereby elevate said first axle,
e. operating the axle extending and retracting motor means of said first axle to extend said first axle,
f. pivoting said boom upwardly by operation of said boom pivoting means to raise the boom outer end above the ground and to simultaneously lower the wheels of said first axle into engagement with the ground, g. rotating said turret to a position in which said boom extends over the second axle, h. pivoting said boom downwardly by operation of said boom pivoting means to engage the outer end of said boom with ground and continuing operation of said boom pivoting means to thereby elevate said second axle, i. operating the axle extending and retracting motor means of said second axle to extend said second axle, and j. pivoting said boom upwardly by operation of said boom pivoting means to raise the boom outer end above the ground and to simultaneously lower the wheels of said second axle into engagement with the ground, k. whereby to provide a base of increased width at both said first and second axles of said vehicle without the use of additional equipment for elevating a part of the vehicle to permit axle extension, so as to provide improved stabilization of said vehicle for all positions of said extendable and pivotable boom and of said rotatable turret.

2. The method of claim 1, wherein said front axle comprises vertically extending pivots at the outer ends thereof with said wheels supported by axle shafts carried by said vertically extending pivots, and wherein each said axle shaft is provided with a steering lever, the steering levers each being connected by a tie rod to a pivotal bar, said method further comprising:

a. providing extensible tie rods and lockind means for said tie rods, b. unlocking said locking means prior to extension of said front axle, and c. relocking said locking means after extension of said front axle.

3. The method of providing stabilization of a vehicle, said vehicle comprising a chassis, front and rear axles supporting said chassis, and wheels on said front and rear axles for supporting said vehicle, and wherein said vehicle further comprises a turret rotatably mounted on said chassis and means for rotating said turret about a vertical axis, a boom pivotally secured to said turret on a horizontal axis and means for vertically pivoting said boom, said boom being telescopic and means for telescopically extending and retracting said boom, said boom having a workman-supporting platform at the end thereof remote from said turret, said method comprising:

a. providing extensible supports for said axles, b. providing motor means for extending and retracting said axles, c. positioning said turret so that said boom extends at an angle to the longitudinal median plane of said chassis, d. raising only one wheel of a said axle by pivoting said boom downwardly by operation of said boom pivoting means to engage the outer end of said boom with the ground and continuing operation of said pivoting means to thereby raise only a single wheel of a said axle, e. operating the axle extending and retracting motor means of the said axle to move said elevated wheel away from the longitudinal median plane of the chassis, f. pivoting said boom upwardly by operation of said boom pivoting means to raise the boom outer end above the ground and simultaneously lower the said elevated wheel into engagement with the ground, g. rotating said turret to a position in which said boom, when pivoted downwardly, will elevate at least one other wheel but only a single wheel of an axle, h. raising at least one other wheel but only a single wheel of an axle by again pivoting said boom downwardly by opertion of said boom pivoting means to engage the outer end of said boom with the ground and continuing operation of said boom pivoting means to thereby elevate at least one other said wheel, i. operating an axle extending and retracting motor means to move an elevated wheel away from the median plane of the chassis, and j. pivoting said boom upwardly by operation of said boom pivoting means to raise the boom outer end above the ground and to simultaneously lower all elevated wheels.

4. The method of claim 3, wherein said boom is initially positioned in a plane substantially parallel to said axles prior to the pivoting of said boom downwardly, to thereby elevate a front and a rear wheel simultaneously.

* * * * *